US007963102B2

(12) United States Patent
Niimi et al.

(10) Patent No.: US 7,963,102 B2
(45) Date of Patent: Jun. 21, 2011

(54) EXHAUST PURIFICATION SYSTEM FOR INTERNAL COMBUSTION ENGINE

(75) Inventors: Kuniaki Niimi, Susono (JP); Tomihisa Oda, Numazu (JP); Takanori Ueda, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 984 days.

(21) Appl. No.: 11/884,128

(22) PCT Filed: Mar. 9, 2006

(86) PCT No.: PCT/JP2006/305191

§ 371 (c)(1),
(2), (4) Date: Aug. 10, 2007

(87) PCT Pub. No.: WO2006/095918

PCT Pub. Date: Sep. 14, 2006

(65) Prior Publication Data

US 2010/0146945 A1 Jun. 17, 2010

(30) Foreign Application Priority Data

Mar. 9, 2005 (JP) ..... 2005-066208

(51) Int. Cl.
*F01N 3/00* (2006.01)
*F01N 3/10* (2006.01)
*F01N 3/02* (2006.01)

(52) U.S. Cl. ..... 60/286; 60/297; 60/295; 60/288; 60/311; 60/301

(58) Field of Classification Search ..... 60/297, 60/295, 288, 311, 301
See application file for complete search history.

(56) References Cited

U.S. PATENT DOCUMENTS

| | | | | |
|---|---|---|---|---|
| 2002/0178716 | A1 | 12/2002 | Hepburn et al. | |
| 2003/0061802 | A1 * | 4/2003 | Nakatani et al. | 60/284 |
| 2003/0066287 | A1 * | 4/2003 | Hirota et al. | 60/297 |
| 2003/0115860 | A1 * | 6/2003 | May et al. | 60/302 |
| 2004/0006977 | A1 * | 1/2004 | Nakatani et al. | 60/288 |

FOREIGN PATENT DOCUMENTS

| | | |
|---|---|---|
| JP | 06-272541 | 9/1994 |
| JP | 07-102947 | 4/1995 |
| JP | 07-102956 | 4/1995 |
| JP | 11-107739 A | 4/1999 |
| JP | 2001-140635 A | 5/2001 |
| JP | 2003-074328 | 3/2003 |
| JP | 2003-106142 A | 4/2003 |
| JP | 2003-120269 A | 4/2003 |

* cited by examiner

*Primary Examiner* — Thomas E Denion
*Assistant Examiner* — Michael Carton
(74) *Attorney, Agent, or Firm* — Kenyon & Kenyon LLP

(57) ABSTRACT

The present invention provides a technology enabling regeneration of the purification performance of an exhaust purification device more reliably and more efficiently in an exhaust purification system combining a plurality of branch passages bifurcating from an exhaust passage and an exhaust purification device provided in each branch passage. When regenerating the purification performance of a first exhaust purification device provided in a first branch passage, a second valve provided in a second branch passage is set at a predetermined first intermediate opening and a first valve provided in the first branch passage is fully closed. Fuel is then added from a first fuel addition valve provided in the first branch passage.

16 Claims, 8 Drawing Sheets

EXHAUST PURIFICATION SYSTEM FOR INTERNAL COMBUSTION ENGINE

This is a 371 national phase application of PCT/JP2006/305191 filed 9 Mar. 2006, claiming priority to Japanese Patent Application No. 2005-066208 filed 9 Mar. 2005, the contents of which are incorporated herein by reference.

FIELD OF THE INVENTION

The present invention relates to an exhaust purification system for an internal combustion engine.

BACKGROUND OF THE INVENTION

NOx and other harmful substances are contained in the exhaust gas of an internal combustion engine. It is known that a NOx catalyst for purifying NOx in the exhaust gas may be provided in the exhaust system of the internal combustion engine to reduce discharge of these harmful substances. In this technology, when a storage-reduction type NOx catalyst is provided, the purification performance decreases as the amount of stored NOx increases, and therefore, a reducer is supplied to the storage-reduction type NOx catalyst to reduce and release the NOx stored in the catalyst (hereinafter referred to as a "NOx reduction treatment").

Furthermore, a reducer is sometimes supplied to the NOx catalyst in addition to raising the bed temperature of the NOx catalyst in order to counteract SOx poisoning in which SOx in the exhaust gas stored in the NOx catalyst results in a decreased purification performance (hereinafter referred to as a "SOx regeneration treatment").

Meanwhile, particulate matter (PM) having carbon as a main component is also contained in the exhaust gas of an internal combustion engine. In a known technology for preventing emission of the particulate matter into the atmosphere, a particulate filter (hereafter referred to as a "filter") is provided in the exhaust system of the internal combustion engine to trap the particulate matter.

In this filter, as the accumulated amount of trapped particulate matter increases, the filter is clogged, causing an increase in back pressure for the gas exhaust and a decrease in the engine performance. As a countermeasure, the exhaust purification performance of the filter can be regenerated by raising the temperature of the exhaust gas that is introduced into the filter such that the temperature of the filter rises and the trapped particulate matter is removed through oxidation (hereafter referred to as "PM regeneration treatment").

As a method of raising the temperature of the exhaust gas that is introduced into the filter during this PM regeneration treatment, an oxidation catalyst capable of oxidation is disposed on the upstream side of the filter, and during PM regeneration treatment, a reducer is supplied to the oxidation catalyst, causing an oxidation reaction in the oxidation catalyst such that the exhaust gas temperature on the upstream side of the filter rises.

It is known that at this time, the flow rate of the exhaust gas introduced into the exhaust purification device is preferably suppressed. The suppression is performed to prevent the supplied reducer from contacting with, and be oxidized by, the high-temperature exhaust gas, as a result of which the reducer can no longer be used for the oxidation reaction in the storage-reduction type NOx catalyst or in the oxidation catalyst, when a reducer is supplied to an exhaust purification device such as a NOx catalyst or filter to regenerate the purification performance.

Japanese Patent Application Publication JP-A-2003-106142 and Japanese Patent Application Publication JP-A-2003-74328 propose a technology in which an exhaust purification system (to be referred to hereafter as an exhaust purification device, and when a control system thereof is included, an "exhaust purification system") is provided with a plurality of branch passages, and an exhaust purification device is disposed in each branch passage. In this technology, the flow rate of exhaust gas introduced into one of the exhaust purification devices is suppressed to a predetermined rate by a valve that is capable of varying the passage sectional area, and fuel serving as a reducer is supplied to the exhaust purification device into which exhaust gas is introduced at the suppressed flow rate. In so doing, the supplied fuel can be used efficiently to regenerate the purification performance of the exhaust purification device, and adverse effects on the operating performance of the internal combustion engine are suppressed.

In relation to this technology, Japanese Patent Application Publication JP-A-HEI7-102947 discloses a technology employed in a structure having a plurality of branch passages and an exhaust purification device disposed in each branch passage. In this technology, an exhaust throttle valve in one of the branch passages is closed, and a reducer is supplied when the flow rate of the exhaust gas has decreased. Further, Japanese Patent Publication No. 2947021 discloses a technology employed in a structure having a plurality of branch passages and a NOx catalyst disposed in each branch passage. In this technology, exhaust gas is led to each branch passage alternately by switching a switch valve. Japanese Patent Publication No. 2727906 also discloses a technology employed in a structure having a plurality of branch passages and a NOx catalyst disposed in each branch passage. In this technology, the flow rate of the exhaust gas that flows through one of the branch passages is reduced, and when the flow rate of the exhaust gas has decreased, a rich spike is implemented.

However, in these technologies, there is still room for improvement in ensuring that the fuel serving as a reducer is supplied reliably to the entire exhaust purification device so that regeneration of the purification performance can be performed efficiently.

An object of the present invention is to provide a technology for regenerating the purification performance of an exhaust purification device more reliably or more efficiently in an exhaust purification system combining a plurality of branch passages bifurcating from an exhaust passage and an exhaust purification device provided in each branch passage.

SUMMARY OF THE INVENTION

To achieve the object described above, the present invention is an exhaust purification system in which an exhaust passage bifurcates into a plurality of branch passages, and an exhaust purification device, reducer adding device, and an exhaust flow control valve are provided in each branch passage. The main features of the present invention are as follows.

When regenerating the purification performance of the exhaust purification device, the exhaust flow control valve in a branch passage provided with the exhaust purification device to be subjected to purification performance regeneration, from among the plurality of branch passages, is substantially fully closed. Further, the opening of the exhaust flow control valve in at least one of the other branch passages is set at a predetermined purification performance regeneration opening.

More specifically, the present invention is an exhaust purification system for an internal combustion engine, comprising:

an exhaust passage, one end of which is connected to the internal combustion engine, through which exhaust gas from the internal combustion engine passes, and which bifurcates midway into a plurality of branch passages;

an exhaust purification device provided in each of the plurality of branch passages for purifying the exhaust gas passing through each of the branch passages;

an exhaust flow control valve provided in each of the plurality of branch passages for controlling a flow rate of the exhaust gas passing through each of the branch passages; and reducer adding device provided upstream of the exhaust purification device in each of the plurality of branch passages for adding a reducer to the exhaust gas passing through each of the branch passages, wherein, when the exhaust purification device provided in one of the plurality of branch passages is to be subjected to purification performance regeneration by supplying the reducer to the exhaust purification device, the exhaust flow control valve in a branch passage provided with the exhaust purification device to be subjected to purification performance regeneration, from among the plurality of branch passages, is substantially fully closed, and an opening of the exhaust flow control valve in at least one of the other branch passages is set at a predetermined purification performance regeneration opening.

Here, when the reducer is supplied to the exhaust purification device provided in each branch passage to regenerate the purification performance of the exhaust purification device, the reducer is added to the exhaust gas passing through the branch passage by the reducer adding device provided on the upstream side of the exhaust purification device. As described above, however, it is known that a part of the added reducer is oxidized through contact with the high-temperature exhaust gas and cannot be used to regenerate the purification performance of the exhaust purification device. Furthermore, as the flow rate of the exhaust gas passing through the branch passage increases, the proportion of reducer that cannot be used to regenerate the purification performance, of the reducer that is added by the reducer adding device, increases. Hence, to improve fuel economy during purification performance regeneration treatment, the flow rate of the exhaust gas passing through the branch passage provided with the exhaust purification device to be subjected to purification performance regeneration should be reduced.

On the other hand, when the reducer added by the reducer adding device converges with exhaust gas having a high flow rate, the reducer can reach the downstream side part of the exhaust purification device. Hence, when the flow rate of the exhaust gas passing through each branch passage is too low, the reducer added by the reducer adding device may be unable to pass through the entire exhaust purification device.

In other words, when regenerating the purification performance of the exhaust purification device, the flow rate of the exhaust gas passing through the branch passage provided with the exhaust purification device to be subjected to purification performance regeneration must be set at an appropriate flow rate taking the two points described above into consideration.

Hence, in the exhaust purification system of the present invention, in which an exhaust passage bifurcates into a plurality of branch passages and an exhaust purification device, reducer adding device, and an exhaust flow control valve are provided in each branch passage, when regenerating the purification performance of the exhaust purification device, the exhaust flow control valve in the branch passage provided with the exhaust purification device to be subjected to purification performance regeneration is substantially fully closed, and the opening of the exhaust flow control valve in at least one of the other branch passages is set at a predetermined purification performance regeneration opening.

Here, substantially fully closed denotes a completely closed state or a state close to a completely closed state such that the exhaust flow in the branch passage reaches zero or near zero.

Here, the predetermined purification performance regeneration opening is an opening within a range extending from an intermediate opening to a fully closed state. Further, the predetermined purification performance regeneration opening is determined to control the flow rate of the exhaust gas passing through the branch passage provided with the exhaust purification device to be subjected to purification performance regeneration before and after the exhaust flow control valve in the branch passage provided with the exhaust purification device to be subjected to purification performance regeneration is substantially fully closed.

By substantially fully closing the exhaust flow control valve in the branch passage provided with the exhaust purification device to be subjected to purification performance regeneration, the flow rate of the exhaust gas in the branch passage can be reduced to substantially zero. Further, by setting the opening of the exhaust flow control valve in at least one of the other branch passages to the predetermined purification performance regeneration opening, the flow rate of the exhaust gas in the branch passage provided with the exhaust purification device to be subjected to purification performance regeneration can be controlled while decreasing to substantially zero in accordance with the purification performance regeneration opening.

As a result, when the reducer is added by the reducer adding device, the flow rate of the exhaust gas in the branch passage provided with the exhaust purification device to be subjected to purification performance regeneration can be brought close to an appropriate flow rate taking the aforementioned two points into consideration. Moreover, the reducer added by the reducer adding device can be supplied to the exhaust purification device more reliably and more efficiently.

Note that here, the exhaust purification device may be a storage-reduction type NOx catalyst, a filter, or a combination thereof. Further, two branch passages are often provided in the exhaust purification system, but there are no particular limitations on the number of branch passages, and two or more may be provided.

Further, the value of the purification performance regeneration opening may be determined appropriately depending on whether the opening of the exhaust flow control valve in one of the other branch passages is set at the purification performance regeneration opening or the opening of the exhaust flow control valves in the plurality of branch passages is set at the purification performance regeneration opening.

Furthermore, in the present invention, a predetermined time difference may be provided between an operation to close the exhaust flow control valve in the branch passage provided with the exhaust purification device to be subjected to purification performance regeneration, from among the plurality of branch passages, substantially fully and an operation to set the opening of the exhaust flow control valve in at least one of the other branch passages to the predetermined purification performance regeneration opening.

Here, a case in which the opening of the exhaust flow control valve in at least one of the other branch passages is set at the predetermined purification performance regeneration opening before the exhaust flow control valve in the branch passage provided with the exhaust purification device to be subjected to purification performance regeneration is substantially fully closed, for example, will be considered. In this case, the flow rate of the exhaust gas in the branch passage provided with the exhaust purification device to be subjected to purification performance regeneration may be temporarily increased. In so doing, the exhaust flow in the branch passage provided with the exhaust purification device to be subjected to purification performance regeneration can be increased at the start of the operation to close the exhaust flow control valve substantially fully. As a result, the width of the variation in the exhaust flow caused by closing the exhaust flow control valve substantially fully can be widened.

As another example for consideration, the opening of the exhaust flow control valve in at least one of the other branch passages is set at the predetermined purification performance regeneration opening after the exhaust flow control valve in the branch passage provided with the exhaust purification device to be subjected to purification performance regeneration is substantially fully closed. In this case, as the flow rate of the exhaust gas in the branch passage provided with the exhaust purification device to be subjected to purification performance regeneration decreases toward substantially zero, the flow rate of the exhaust gas passing through the branch passage can be increased relatively. Thus, the manner in which the exhaust flow decreases when the exhaust flow control valve in the branch passage provided with the exhaust purification device to be subjected to purification performance regeneration is substantially fully closed can be varied.

By providing a predetermined time difference between the operation to close the exhaust flow control valve substantially fully and the operation to set the opening of the exhaust flow control valve at the predetermined purification performance regeneration opening in this manner, the manner in which the exhaust flow in the branch passage provided with the exhaust purification device to be subjected to purification performance regeneration varies when the exhaust flow control valve is substantially fully closed can be controlled with a greater degree of freedom.

Further, in the present invention, when an operational state of the internal combustion engine belongs to a predetermined low load region and the purification performance of the exhaust purification device provided in one of the plurality of branch passages is to be regenerated by supplying the reducer to the exhaust purification device, the opening of the exhaust flow control valve in at least one of the other branch passages may be set at the purification performance regeneration opening, and after the elapse of a predetermined first time period, the exhaust flow control valve in the branch passage provided with the exhaust purification device to be subjected to purification performance regeneration may be substantially fully closed.

In other words, when the operational state of the internal combustion engine belongs to the low load region, the amount of exhaust gas discharged from the internal combustion engine is low. Hence, when the exhaust flow control valve in the branch passage provided with the exhaust purification device to be subjected to purification performance regeneration is substantially fully closed, the flow rate of the exhaust gas passing through the branch passage at an initial stage, in which the flow rate begins to decrease, is low, and as a result, it may be impossible to supply the reducer added by the reducer adding device to the exhaust purification device to be subjected to purification performance regeneration sufficiently.

Hence, when the operational state of the internal combustion engine belongs to the predetermined low load region and the purification performance of the exhaust purification device provided in one of the plurality of branch passages is to be regenerated, the opening of the exhaust flow control valve in at least one of the other branch passages is set at the purification performance regeneration opening. Then, once the predetermined first time period has elapsed, the exhaust flow control valve in the branch passage provided with the exhaust purification device to be subjected to purification performance regeneration is substantially fully closed.

In so doing, the flow rate of the exhaust gas in the branch passage provided with the exhaust purification device to be subjected to purification performance regeneration can be temporarily increased. Thereafter, by substantially fully closing the exhaust flow control valve in the branch passage provided with the exhaust purification device to be subjected to purification performance regeneration, the flow rate of the exhaust gas can be reduced again to substantially zero. Hence, even when the flow rate of the exhaust gas passing through the branch passage provided with the exhaust purification device to be subjected to purification performance regeneration is small, a sufficient amount of the reducer can be supplied to the exhaust purification device to be subjected to purification performance regeneration.

Here, the predetermined low load region is an operating region in which the engine load is small. When the operational state of the internal combustion engine belongs to this region and the exhaust flow control valve in the branch passage provided with the exhaust purification device to be subjected to purification performance regeneration is simply substantially fully closed, the flow rate of the exhaust gas passing through the branch passage is small, and hence in this operating region, it is believed to be impossible to supply sufficient reducer to the exhaust purification device to be subjected to purification performance regeneration. This operating region may be experimentally determined in advance.

Further, the predetermined first time period is the time difference between the operation to close the exhaust flow control valve substantially fully and the operation to set the opening of the exhaust flow control valve in at least one of the other branch passages at the predetermined purification performance regeneration opening. By setting this time difference as the first time period, the exhaust flow at the start of control to close the exhaust flow control valve in the branch passage provided with the exhaust purification device to be subjected to purification performance regeneration substantially fully can be set such that a sufficient amount of the reducer can be supplied to the exhaust purification device to be subjected to purification performance regeneration. The first time period may be experimentally obtained in advance.

Whether or not the exhaust flow at the start of control to close the exhaust flow control valve in the branch passage provided with the exhaust purification device to be subjected to purification performance regeneration substantially fully can actually be raised sufficiently is determined according to a combination of the first time period and the purification performance regeneration opening.

Further, in the present invention, when the operational state of the internal combustion engine belongs to a predetermined medium-low load region and the purification performance of the exhaust purification device provided in one of the plurality of branch passages is to be regenerated by supplying the reducer to the exhaust purification device, the exhaust flow control valve in the branch passage provided with the exhaust purification device to be subjected to purification performance regeneration may be substantially fully closed, and after the elapse of a predetermined second time period, the opening of the exhaust flow control valve in at least one of the other branch passages may be set at the purification performance regeneration opening.

In other words, when the operational state of the internal combustion engine belongs to the low-medium load region, the amount of exhaust gas discharged from the internal combustion engine is comparatively large. Hence, when the exhaust flow control valve in the branch passage provided with the exhaust purification device to be subjected to purification performance regeneration is substantially fully closed, sufficient transportability for supplying the reducer added by the reducer adding device to the exhaust purification device to be subjected to purification performance regeneration can be secured.

In such a case, when the purification performance of the exhaust purification device provided in one of the plurality of branch passages is to be regenerated by supplying the reducer to the exhaust purification device, the exhaust flow control valve in the branch passage provided with the exhaust purification device to be subjected to purification performance regeneration is substantially fully closed, and after the elapse of the predetermined second time period, the opening of the exhaust flow control valve in at least one of the other branch passages is set at the purification performance regeneration opening.

Thus, after substantially fully closing the exhaust flow control valve in the branch passage provided with the exhaust purification device to be subjected to purification performance regeneration, the flow rate of the exhaust gas attempting to flow into the branch passage is relatively increased. As a result, the decrease gradient of the exhaust flow in the branch passage can be made gentler. Hence, the reducer added by the reducer adding device can be supplied to the exhaust purification device to be subjected to purification performance regeneration with stability over a longer time period.

Here, the predetermined medium-low load region is a region in which the engine load is larger than the aforementioned low load region. When the operational state is in this region, it is believed to be possible to secure a sufficient exhaust flow for supplying the reducer added by the reducer adding device to the exhaust purification device to be subjected to purification performance regeneration even when the exhaust flow control valve in the branch passage provided with the exhaust purification device to be subjected to purification performance regeneration is substantially fully closed. This operating region may be experimentally determined in advance.

Further, the predetermined second time period is the time difference between the operation to close the exhaust flow control valve substantially fully and the operation to set the opening of the exhaust flow control valve in at least one of the other branch passages at the predetermined purification performance regeneration opening. By setting this time difference as the second time period, the decrease gradient of the exhaust flow from the start of control to close the exhaust flow control valve in the branch passage provided with the exhaust purification device to be subjected to purification performance regeneration substantially fully can be made gentler. The second time period may be experimentally determined in advance.

Whether or not the decrease gradient of the exhaust flow from the start of control to close the exhaust flow control valve in the branch passage provided with the exhaust purification device to be subjected to purification performance regeneration substantially fully can actually be made sufficiently gentler is determined according to a combination of the second time period and the purification performance regeneration opening.

Further, in the present invention, the purification performance regeneration opening is an opening of the exhaust flow control valve in at least one of the other branch passages at which the purification performance of the exhaust purification device to be subjected to purification performance regeneration is substantially optimized following purification performance regeneration, and may be determined in accordance with the operational state of the internal combustion engine.

Here, the manner in which the exhaust flow in the branch passage provided with the exhaust purification device to be subjected to purification performance regeneration varies when the exhaust flow control valve therein is substantially fully closed differs according to the opening of the exhaust flow control valve in the other branch passage, as described above. Similarly, variation in the exhaust flow also differs according to the operational state of the internal combustion engine at this time.

Hence, the exhaust flow in the branch passage provided with the exhaust purification device to be subjected to purification performance regeneration when the reducer is added by the reducer adding device and thereafter varies according to the opening of the exhaust flow control valve in the other branch passage and the operational state of the internal combustion engine. The manner in which the reducer added by the reducer adding device reaches the exhaust purification device to be subjected to purification performance regeneration also varies according to these factors, and as a result, the degree of purification performance regeneration in the exhaust purification device to be subjected to purification performance regeneration also varies.

In the present invention, the value of the purification performance regeneration opening at which the purification performance of the exhaust purification device to be subjected to purification performance regeneration can be optimized may be determined in advance in accordance with the operational state of the internal combustion engine. Then, when the purification performance of the exhaust purification device is to be regenerated, the exhaust flow control valve in the branch passage provided with the exhaust purification device to be subjected to purification performance regeneration is substantially fully closed. Further, the opening of the exhaust flow control valve in at least one of the other branch passages is set at the purification performance regeneration opening for optimizing the purification performance of the exhaust purification device to be subjected to purification performance regeneration following regeneration.

In so doing, the purification performance of the exhaust purification device to be subjected to purification performance regeneration can be regenerated to an optimum state, regardless of the operational state of the internal combustion engine.

Further, in the present invention, the purification performance regeneration opening is a minimum opening of a range in which an effect on an engine output of the internal combustion engine does not exceed a predetermined allowable value when the exhaust flow control valve in the branch passage provided with the exhaust purification device to be subjected to purification performance regeneration is substantially fully closed and the opening of the exhaust flow control valve in at least one of the other branch passages is set at the purification performance regeneration opening, and may be determined in accordance with the operational state of the internal combustion engine.

Here, a case in which, when regenerating the purification performance of the exhaust purification device provided in one of the plurality of branch passage by supplying the reducer thereto, the exhaust flow control valve in the passages is substantially fully closed and the opening of the exhaust flow control valve in one of the other branch passages, for example, is closed from a fully open state to the purification performance regeneration opening will be considered. In this case, the total amount of exhaust gas that can pass through all of the plurality of branch passages decreases.

By substantially fully closing the exhaust flow control valve in the branch passage provided with the exhaust purification device to be subjected to purification performance regeneration and setting the opening of the exhaust flow control valve in at least one of the other branch passages at the purification performance regeneration opening in accordance with the operational state of the internal combustion engine, effects such as a reduction in the engine output of the internal combustion engine may occur.

Hence, in the present invention, the purification performance regeneration opening may be determined as follows. The purification performance regeneration opening is set at an opening at which the effect on the engine output of the internal combustion engine does not exceed a predetermined allowable value even when the exhaust flow control valve in the branch passage provided with the exhaust purification device to be subjected to purification performance regeneration is substantially fully closed and the opening of the exhaust flow control valve in at least one of the other branch passages is closed to the purification performance regeneration opening, and is also set at a minimum value within this range. The purification performance regeneration opening may be determined in advance in accordance with the operational state of the internal combustion engine.

Here, the predetermined allowable value is a degree of the effect on the engine output of the internal combustion engine, which serves as a threshold at which a driver does not feel a sense of discomfort at the reduction in the engine output of the internal combustion engine, and may be experimentally determined in advance.

Thus, the exhaust flow in the branch passage provided with the exhaust purification device to be subjected to purification performance regeneration can be increased as far as possible within a range that does not affect the engine output of the internal combustion engine. As a result, the reducer added by the reducer adding device can be supplied to the exhaust purification device to be subjected to purification performance regeneration more reliably, and an excessive effect on the engine output of the internal combustion engine can be suppressed.

Further, in the present invention, the purification performance regeneration opening may be set as the larger opening between an opening of the exhaust flow control valve in at least one of the other branch passages at which the purification performance of the exhaust purification device to be subjected to purification performance regeneration is substantially optimized following purification performance regeneration, which is determined in accordance with the operational state of the internal combustion engine, and a minimum opening of a range in which an effect on an engine output of the internal combustion engine does not exceed a predetermined allowable value when the exhaust flow control valve in the branch passage provided with the exhaust purification device to be subjected to purification performance regeneration is substantially fully closed and the opening of the exhaust flow control valve in at least one of the other branch passages is set at the purification performance regeneration opening, which is determined in accordance with the operational state of the internal combustion engine.

For example, the value of the opening of the exhaust flow control valve in at least one of the other branch passages for optimizing the purification performance of the exhaust purification device to be subjected to purification performance regeneration following regeneration is determined in advance in accordance with the operational state of the internal combustion engine, and this value is basically set as the purification performance regeneration opening. Then, when the purification performance regeneration opening determined in this manner is smaller than the minimum valve opening of a range in which the effect on the engine output of the internal combustion engine does not exceed the predetermined allowable value, the minimum valve opening of the range in which the effect on the engine output of the internal combustion engine does not exceed the predetermined allowable value is set as the purification performance regeneration opening.

In so doing, the purification performance of the exhaust purification device to be subjected to purification performance regeneration following regeneration can be maximized, regardless of the operational state of the internal combustion engine, and an excessive effect on the engine output of the internal combustion engine can be suppressed.

Further, in the present invention, the purification performance regeneration opening may be corrected on the basis of at least one of a temperature of the exhaust purification device to be subjected to purification performance regeneration and a back pressure produced by the exhaust purification device to be subjected to purification performance regeneration in the branch passage provided with the exhaust purification device.

Here, when the operational state of the internal combustion engine is constant, the value of the purification performance regeneration opening for optimizing the purification performance of the exhaust purification device to be subjected to purification performance regeneration following regeneration is believed to increase steadily as the temperature of the exhaust purification device rises. The reason for this is that as the temperature of the exhaust purification device to be subjected to purification performance regeneration rises, a reducer reaction occurs more easily, and therefore the purification performance can be regenerated sufficiently using a small amount of reducer.

Further, when the operational state of the internal combustion engine is constant, the minimum valve opening of the range in which the effect on the engine output of the internal combustion engine does not exceed the predetermined allowable value is believed to increase steadily as the back pressure produced by the exhaust purification device to be subjected to purification performance regeneration in the branch passage provided with the exhaust purification device rises. The reason for this is that when the back pressure produced by the exhaust purification device to be subjected to purification performance regeneration in the branch passage provided with the exhaust purification device is high, the engine output of the internal combustion engine is likely to be greatly affected unless the total value of the exhaust flow that can pass through the plurality of branch passages is increased by increasing the valve opening of the exhaust flow control valve in the other branch passage.

Hence, the purification performance regeneration opening is preferably corrected on the basis of at least one of the temperature of the exhaust purification device to be subjected to purification performance regeneration and the back pressure produced by the exhaust purification device to be subjected to purification performance regeneration in the branch passage provided with the exhaust purification device. In so doing, the purification performance of the exhaust purification device to be subjected to purification performance regeneration following regeneration can be optimized more reliably, regardless of the operational state of the internal combustion engine. Moreover, situations in which the effect on the engine output of the internal combustion engine increases so as to impede drivability can be suppressed more reliably.

More specifically, the purification performance regeneration opening may be corrected to the larger side as the temperature of the exhaust purification device to be subjected to purification performance regeneration increases. Further, the purification performance regeneration opening may be corrected to the larger side as the back pressure produced by the exhaust purification device to be subjected to purification performance regeneration in the branch passage provided with the exhaust purification device increases.

Further, in the present invention, when the purification performance regeneration for the exhaust purification device provided in one of said plurality of branch passages is complete, and the exhaust purification device in the branch passage provided with the exhaust flow rate control valve that is set at the purification performance regeneration opening during the regeneration is subjected to purification performance regeneration immediately afterwards, the opening of the exhaust flow control valve in the branch passage provided with the exhaust purification device that has completed purification performance regeneration may be switched from a substantially fully closed state to the purification performance regeneration opening, and the opening of the exhaust flow control valve in the branch passage provided with the exhaust purification device to be subjected to purification performance regeneration subsequently may be switched from the purification performance regeneration opening to the substantially fully closed state.

In other words, when the exhaust purification devices provided in the plurality of branch passages are to be subjected to purification performance regeneration consecutively, first, the exhaust flow control valve in the branch passage provided with the exhaust purification device to be subjected to purification performance regeneration first is closed and the opening of the exhaust flow control valve in at least one of the other branch passages is set at the purification performance regeneration opening. Then, when the first purification performance regeneration operation is complete, the opening of the exhaust flow control valve provided in the corresponding branch passage is set directly at the purification performance regeneration opening rather than being returned to a fully open state. Meanwhile, the exhaust flow control valve in the branch passage provided with the exhaust purification device to be subjected to purification performance regeneration next is substantially fully closed. If the exhaust flow control valve in the branch passage provided with the exhaust purification device to be subjected to purification performance regeneration next is at the purification performance regeneration opening at this time, the exhaust flow control valve is substantially fully closed directly rather than being returned to a fully open state.

Thus, when the exhaust purification devices provided in the plurality of branch passages are subjected to purification performance regeneration consecutively, the driving amount of the exhaust flow control valve provided in each branch passage can be minimized. Back pressure variation in all of the branch passages can also be minimized. As a result, the effect on the engine output of the internal combustion engine can be suppressed, and both power consumption and noise can be reduced.

Note that means for solving the problems in the present invention may be used in combination as far as possible.

DETAILED DESCRIPTION

Best modes for carrying out the present invention will be described in detail below using examples, with reference to the drawings.

First Embodiment

Figure 1:
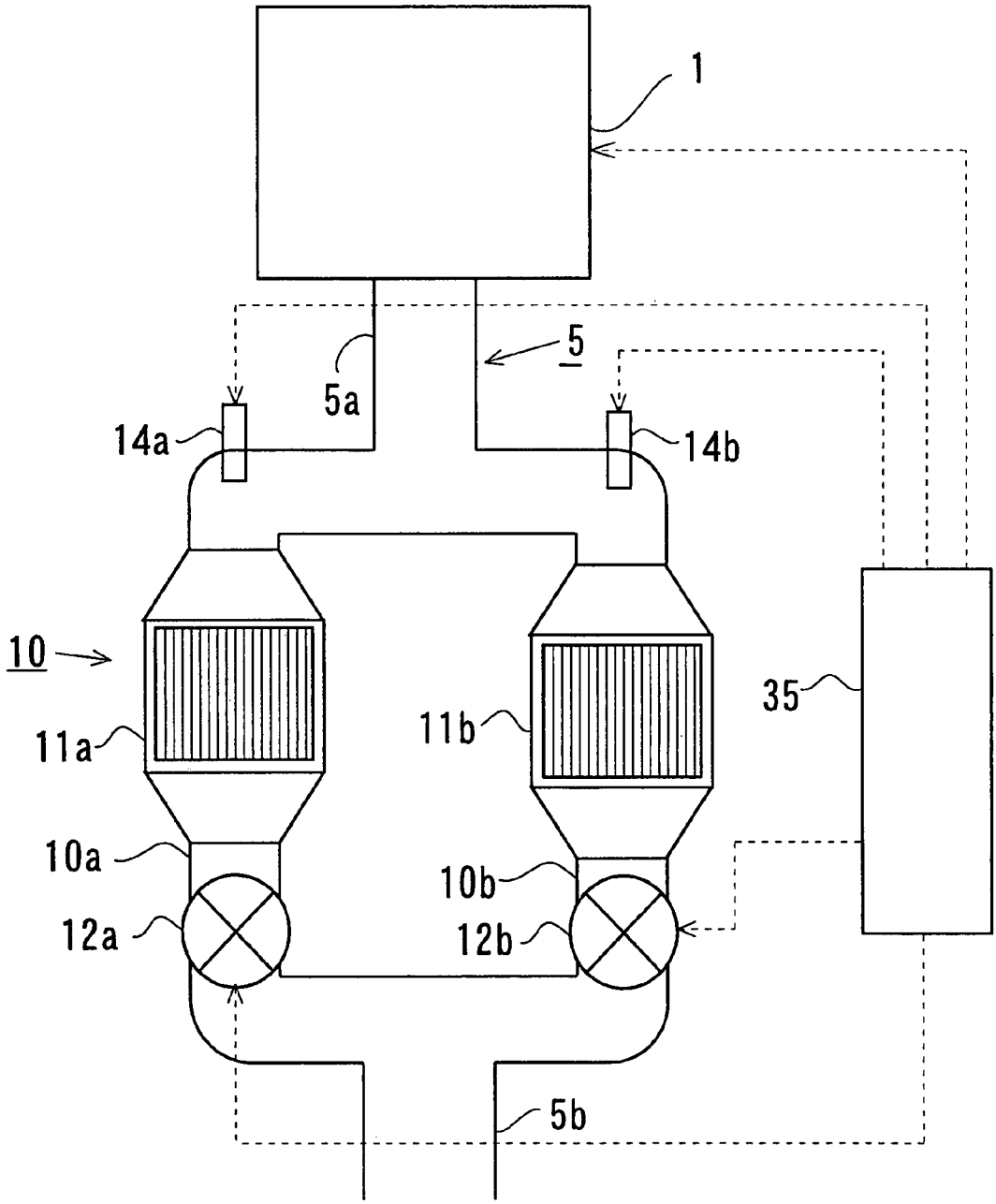
FIG. 1 is a view showing the schematic constitution of an internal combustion engine according to an embodiment of the present invention, and an exhaust system and a control system thereof.

FIG. 1 shows the schematic constitution of an internal combustion engine according to this embodiment, and an exhaust system and a control system thereof. An internal combustion engine 1 shown in FIG. 1 is a diesel engine. Note that in FIG. 1, the interior and intake system of the internal combustion engine 1 have been omitted.

In FIG. 1 an exhaust pipe 5 through which exhaust gas flows following discharge from the internal combustion engine 1 is connected to the internal combustion engine 1, and the exhaust pipe 5 is connected downstream to a muffler, not shown in the drawing. An exhaust purification unit 10 for removing particulate matter (soot, for example) and NOx from the exhaust gas is disposed at a point in the exhaust pipe 5. Hereafter, the part of the exhaust pipe 5 on the upstream side of the exhaust purification unit 10 will be referred to as a first exhaust pipe 5*a*, and the part on the downstream side will be referred to as a second exhaust pipe 5*b*. Further, in the exhaust purification unit 10, the first exhaust pipe 5*a* bifurcates into a first branch passage 10*a* and a second branch passage 10*b*, and the first branch passage 10*a* and second branch passage 10*b* meet downstream to form the second exhaust pipe 5*b*. A first exhaust purification device 11*a* for trapping particulate matter (soot, for example) in the exhaust gas and also storing and reducing NOx in the exhaust gas is provided in the first branch passage 10*a*, while an identical second exhaust purification device 11*b* is provided in the second branch passage 10*b*. Here, the first exhaust pipe 5*a* and second exhaust pipe 5*b* together constitute an exhaust passage of this embodiment. The first branch passage 10*a* and second branch passage 10*b* constitute branch passages of this embodiment.

The first exhaust purification device 11*a* and second exhaust purification device 11*b* of this embodiment are wall flow type filters constituted by a porous base material and carrying a storage-reduction type NOx catalyst. Note, however, that the first exhaust purification device 11*a* and second exhaust purification device 11*b* need not be constituted by filters carrying storage-reduction type NOx catalysts. For example, the first exhaust purification device 11*a* and second exhaust purification device 11*b* may be constituted by a filter not carrying a storage-reduction type NOx catalyst and a storage-reduction type NOx catalyst provided in series therewith.

Further, a first valve 12*a* for controlling the flow rate of the exhaust gas that passes through the first branch passage 10*a* is provided in a part of the first branch passage 10*a* downstream of the first exhaust purification device 11*a*. Similarly, a second valve 12*b* is provided in a part of the second branch passage 10*b* downstream of the second exhaust purification device 11*b*. Note that the first valve 12*a* and second valve 12*b* constitute exhaust flow control valves of this embodiment.

In FIG. 1, a first fuel addition valve 14*a* for adding fuel serving as a reducer to the exhaust gas during NOx reduction treatment or the like in the first exhaust purification device 11*a* is provided in the first branch passage 10*a* on the upstream side of the first exhaust purification device 11*a*. Similarly, a second fuel addition valve 14*b* is provided in the second branch passage 10*b* on the upstream side of the second exhaust purification device 11*b*. Note that the first fuel addition valve 14*a* and second fuel addition valve 14*b* constitute reducer adding device of this embodiment.

An electronic control unit (ECU) 35 for controlling the internal combustion engine 1 and exhaust system constituted as described above is annexed thereto. The ECU 35 is a unit for controlling the operational state of the internal combustion engine 1 and so on in accordance with the operating conditions of the internal combustion engine 1 and requests from a driver, and performing control relating to the exhaust purification unit 10 of the internal combustion engine 1.

Sensor types relating to control of the operational state of the internal combustion engine 1, such as a crank position sensor and an accelerator position sensor, not shown in the drawing, are connected to the ECU 35 via electric wiring, and output signals from these sensors are input into the ECU 35. Meanwhile, a fuel injection valve and so on, not shown in the drawing, in the interior of the internal combustion engine 1 are connected to the ECU 35 via electric wiring, while the first valve 12*a*, second valve 12*b*, first fuel addition valve 14*a* and second fuel addition valve 14*b* of this embodiment are connected to the ECU 35 via electric wiring so as to be controlled thereby.

The ECU 35 is also provided with a CPU, ROM, RAM, and so on, while programs for controlling the internal combustion engine 1 in various ways and maps storing data are stored in the ROM. In addition to a NOx reduction treatment routine for reducing and discharging NOx stored in the first exhaust purification device 11*a* and second exhaust purification device 11*b*, a SOx poisoning recovery treatment routine for reducing and discharging SOx stored in the first exhaust purification device 11*a* and second exhaust purification device 11*b*, a PM regeneration treatment routine for oxidizing and removing accumulated particulate matter trapped in the first exhaust purification device 11*a* and second exhaust purification device 11*b*, and so on serve as programs stored in the ROM of the ECU 35 (description of these routines is omitted).

Figure 2:
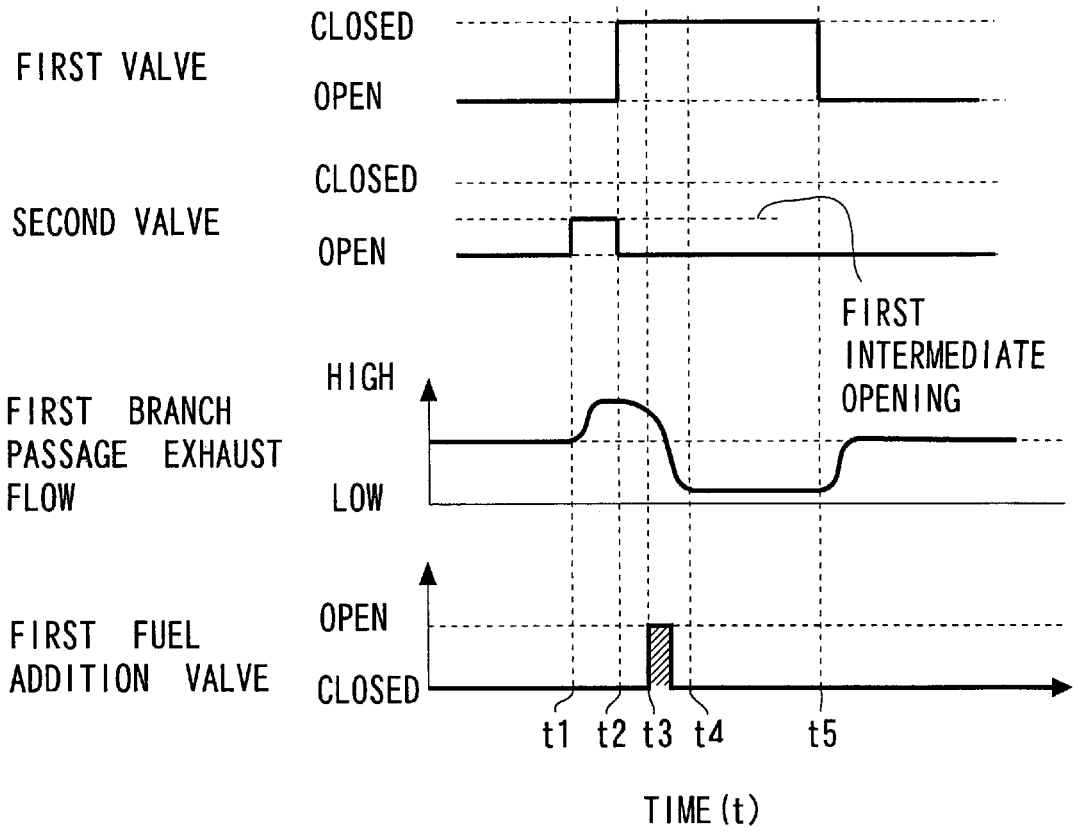
FIG. 2 is a time chart showing open/close operations of a first valve and a second valve, variation in an exhaust flow in a first branch passage accompanying these open/close operations, and an open/close operation of a first fuel addition valve when NOx reduction treatment is performed on a first exhaust purification device according to a first embodiment of the present invention.

Next, control performed during NOx reduction treatment in the exhaust purification system of this embodiment will be described. First, using FIG. 2, a case in which NOx reduction treatment is performed on the first exhaust purification device 11*a* when the operational state of the internal combustion engine 1 belongs to a low load region and a reducer cannot be supplied to the exhaust purification device sufficiently even by adding the reducer as is to the exhaust gas passing through each branch passage will be described. FIG. 2 is a time chart showing open/close operations of the first valve 12*a* and second valve 12*b*, variation in the exhaust flow in the first branch passage 10*a* accompanying the open/close operations of the first valve 12*a* and second valve 12*b*, and an open/close operation of the first fuel addition valve 14*a* when NOx reduction treatment is performed on the first exhaust purification device 11*a*. The abscissa in FIG. 2 shows time.

As shown in FIG. 2, during a normal operation of the internal combustion engine 1, both the first valve 12*a* and second valve 12*b* are fully open. During NOx reduction treatment of the first exhaust purification device 11*a*, first, at a time t1, the second valve 12*b* is closed to a first intermediate opening. As a result, a part of the exhaust gas passing through the second branch passage 10*b* up to this point passes through the first branch passage 10*a*, and therefore the flow rate of the exhaust gas passing through the first branch passage 10*a* once increases.

Next, at a time t2 when the flow rate of the exhaust gas passing through the first branch passage 10*a* has stabilized, the first valve 12*a* is closed fully. As a result, the amount of exhaust gas passing through the first branch passage 10*a* decreases rapidly to substantially zero. Furthermore, in this embodiment, at the time t2, the second valve 12*b* is returned to the fully open state.

Next, at a time t3 between the time t2, at which the rapid variation in the exhaust flow described above begins, and a time t4, at which the rapid variation in the exhaust flow ends, the first fuel addition valve 14*a* is operated such that fuel serving as a reducer is added to the exhaust gas passing through the first branch passage 10*a*. In so doing, the fuel serving as a reducer can be added to the exhaust gas passing through the first branch passage 10*a* at the appropriate time point during the process, in which the flow rate of the exhaust gas passing through the first branch passage 10*a*, which was increased temporarily at the time t1, has decreased.

Next, at a time t5 after enough time has passed for a NOx reduction reaction to occur sufficiently in the first exhaust purification device 11*a*, the first valve 12*a* is fully opened. Thus both the first valve 12*a* and second valve 12*b* are fully open, and therefore the flow rate of the exhaust gas passing through the first branch passage 10*a* returns to the intermediate flow rate prior to the start of NOx reduction treatment.

As described above, in this embodiment a state in which the operational state of the internal combustion engine 1 belongs to the low load region and the reducer cannot be supplied to the exhaust purification device sufficiently even by adding the reducer as is to the exhaust gas passing through each branch passage was considered. When the NOx reduction treatment of the first exhaust purification device 11*a* is performed in this state, first the second valve 12*a* is closed to the first intermediate opening to increase the flow rate of the exhaust gas passing through the first branch passage 10*a* temporarily. Then, once the flow rate of the exhaust gas passing through the first branch passage 10*a* has stabilized, the first valve 12*a* is closed fully and the second valve 12*b* is returned to a fully open state such that the flow rate of the exhaust gas passing through the first branch passage 10*a* decreases rapidly.

Then, during variation of the exhaust flow in the first branch passage 10*a*, fuel serving as a reducer is supplied from the first fuel addition valve 14*a*. In so doing, the flow rate of the exhaust gas passing through the first branch passage can be increased temporarily and then reduced even when the operational state of the internal combustion engine 1 belongs to the low load region and the flow rate of the exhaust gas discharged from the internal combustion engine 1 is low. Accordingly, the fuel added by the first fuel addition valve 14*a* can be supplied to the first exhaust purification device 11*a* more reliably. As a result, the NOx reduction treatment of the first exhaust purification device 11*a* can be completed more reliably.

Figure 3:
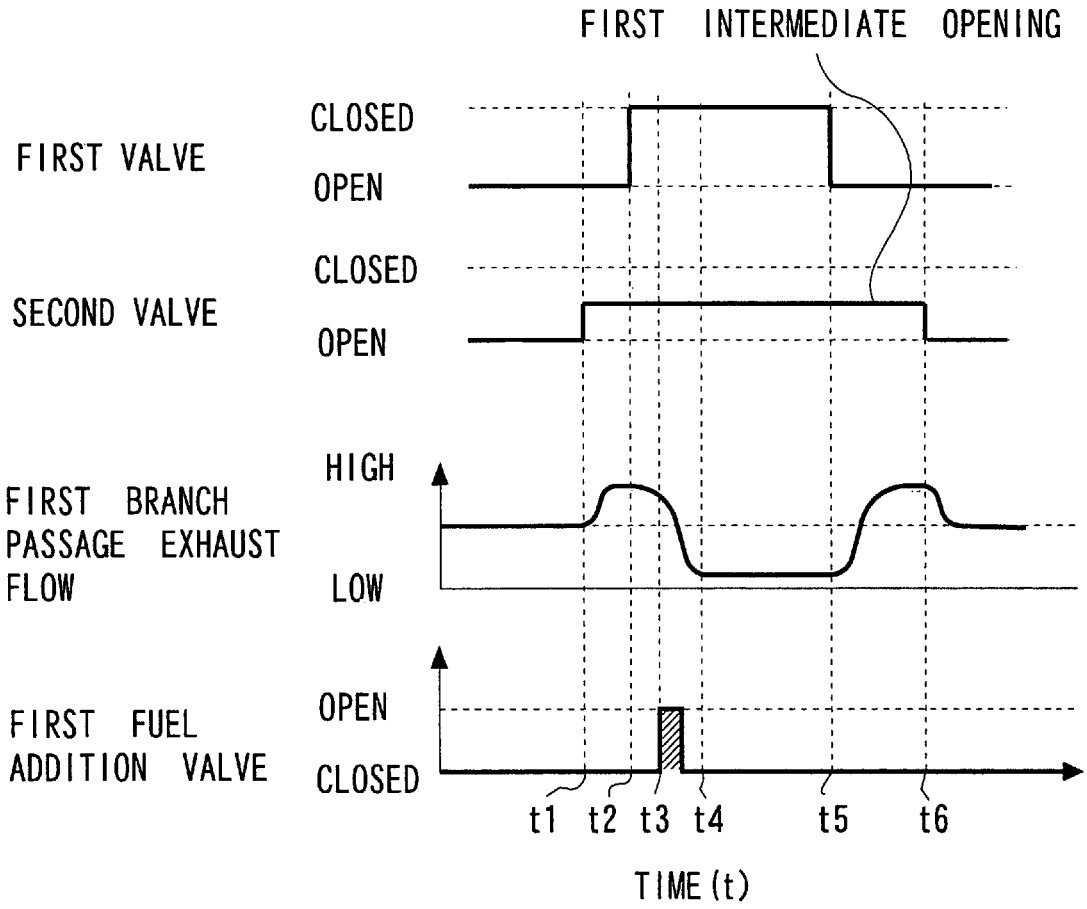
FIG. 3 is a time chart showing another example of the open/close operations of the first valve and second valve, variation in the exhaust flow in the first branch passage accompanying these open/close operations, and the open/close operation of the first fuel addition valve when NOx reduction treatment is performed on the first exhaust purification device according to the first embodiment of the present invention.

Note that in this example, control is performed to close the second valve 12*b* to the first intermediate opening at the time t1 and then return the second valve 12*b* to a fully open state at the time t2. In contrast, as shown in FIG. 3, the second valve 12*b* may be held at the first intermediate opening for a predetermined amount of time following full opening of the first valve 12*a* at a time t5, and then fully opened at a time t6. In so doing, rapid variation in the total exhaust flow through the first branch passage 10*a* and second branch passage 10*b* can be suppressed, enabling the suppression of torque shock. Furthermore, the operation times of the first valve 12*a* and second valve 12*b* can be prevented from overlapping, and an increase in noise during valve driving can be suppressed.

Here, the first intermediate opening in FIG. 2 and FIG. 3 corresponds to a purification performance regeneration opening of this embodiment, and the value of this opening may be set at a predetermined fixed value. Further, an optimum value corresponding to the operational state of the internal combustion engine 1 may be determined as this value each time NOx reduction treatment is performed. In other words, the amount of exhaust gas discharged from the internal combustion engine 1 varies according to the operational state of the internal combustion engine 1, and therefore, the value of the first intermediate opening may be determined in accordance with the operational state of the internal combustion engine 1 such that the NOx purification performance of the first exhaust purification device 11*a* following the completion of NOx reduction treatment is optimized. This means that the NOx purification performance of the first exhaust purification device 11*a* following NOx reduction treatment is dependent on whether or not an appropriate amount of fuel has been supplied to the entire first exhaust purification device 11*a* reliably.

To achieve this, a map storing a relationship between the operational state of the internal combustion engine 1 and a first intermediate opening value for optimizing the NOx purification performance of the exhaust purification device following the completion of NOx reduction treatment may be created in advance through experiment, and a valve opening value of the second valve 12*b* may be read and determined from the map to correspond to the operational state of the internal combustion engine 1.

Figure 4:
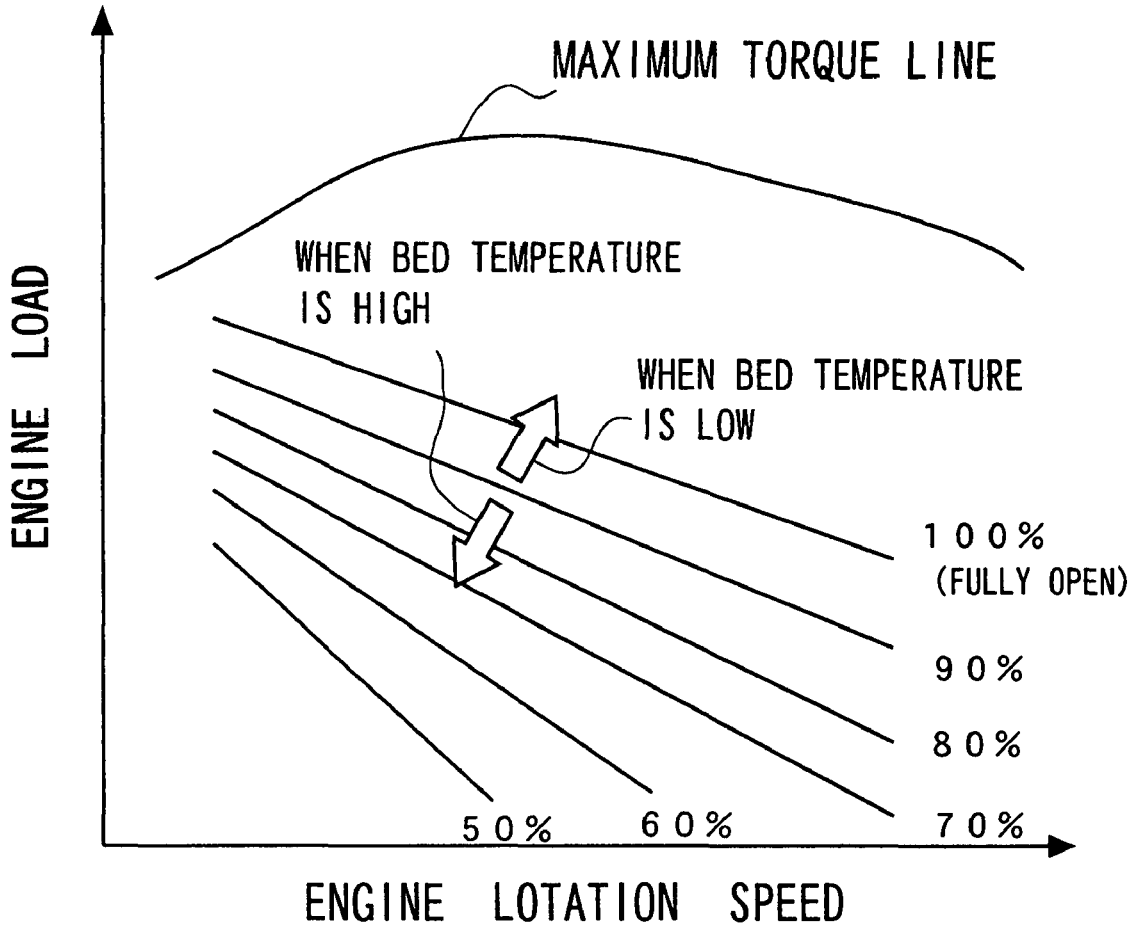
FIG. 4 is a graph illustrating a relationship between an operational state of the internal combustion engine according to the first embodiment of the present invention, and a valve opening of the second valve during NOx reduction treatment for optimizing the NOx purification performance of the first exhaust purification device following NOx reduction treatment.

FIG. 4 shows an example of a graph based on the map described above, illustrating the relationship between the operational state of the internal combustion engine 1 and the value of the first intermediate opening for optimizing the NOx purification performance of the first exhaust purification device 11*a* following the completion of NOx reduction treatment, corresponding to the operational state of the internal combustion engine 1. In FIG. 4, the abscissa shows the engine rotation speed and the ordinate shows the engine load. The solid straight lines indicate the value of the first intermediate opening to be selected at each engine rotation speed and each engine load.

Note that this relationship between the operational state of the internal combustion engine 1 and the first intermediate opening may be corrected according to the temperature of the first exhaust purification device 11*a* to be subjected to purification performance regeneration. In other words, when the temperature of the first exhaust purification device 11*a* is high, the reactivity of the NOx catalyst in the first exhaust purification device 11*a* rises, and therefore high purification efficiency can be obtained even when the amount of fuel reaching the first exhaust purification device 11*a* is small. Hence, the value of the first intermediate opening shifts to the high side in the same operational state.

More specifically, the map from which the first intermediate opening is read may be modified according to the temperature of the first exhaust purification device 11*a* to be subjected to purification performance regeneration. Alternatively, the map from which the first intermediate opening is read may be left unchanged, irrespective of the temperature of the first exhaust purification device 11*a*, and the final value of the first intermediate opening may be determined by multiplying a coefficient corresponding to the temperature of the first exhaust purification device 11*a* by the value read from the map.

Further, the first intermediate opening in FIG. 2 may be determined in accordance with the operational state of the internal combustion engine 1 as a minimum value of a range in which the effect on the engine output of the internal combustion engine 1 does not exceed an allowable value.

In other words, when the second valve 12*a* is closed to the first intermediate opening at the time t1, the total flow rate of the exhaust gas that can pass through the two branch passages decreases, and therefore the engine output of the internal combustion engine 1 may be affected, depending on the operational state thereof. Further, particularly when the control shown in FIG. 3 is performed, the total flow rate of the exhaust gas that can pass through the two branch passages also decreases at the time t2, when the first valve 12*a* is fully closed, and the engine output of the internal combustion engine 1 may also be affected thereby. When the effect is great, the operating performance of the internal combustion engine 1 may deteriorate.

Hence, a map storing a relationship between the operational state of the internal combustion engine 1 and a first intermediate opening serving as a minimum opening of a range in which the effect on the engine output of the internal combustion engine 1 does not exceed an allowable value may be prepared in advance, and a value of the first intermediate opening corresponding to the operational state of the internal combustion engine 1 may be read from this map. Here, the allowable value is a degree of the effect on the engine output in the form of a threshold at which a reduction in the engine output of the internal combustion engine 1 does not cause the driver to feel uncomfortable, and may be experimentally determined in advance.

In so doing, the purification performance of the exhaust purification device can be regenerated more reliably, and regeneration of the purification performance of the exhaust purification device can be prevented from affecting the operating performance of the internal combustion engine 1 excessively.

Figure 5:
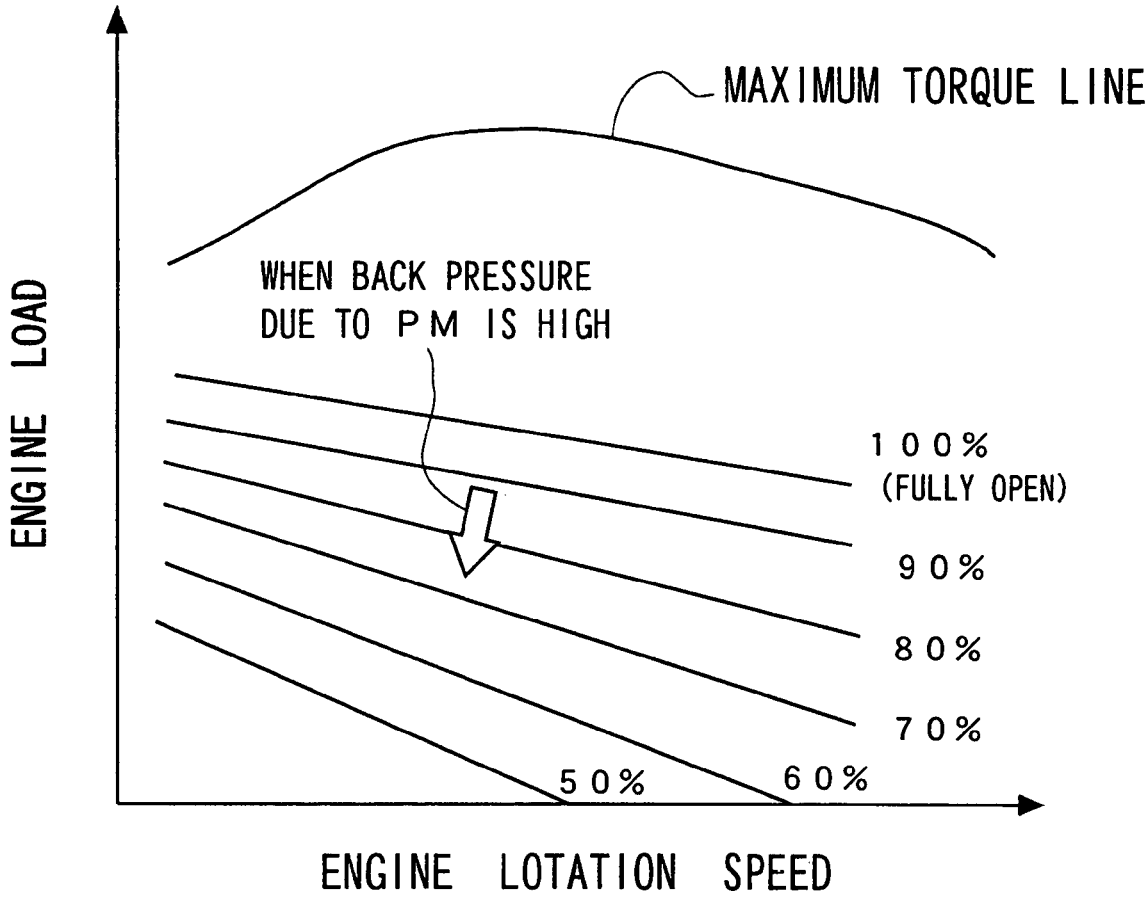
FIG. 5 is a graph illustrating the relationship between the operational state of the internal combustion engine according to the first embodiment of the present invention, and a minimum valve opening of the second valve, during NOx reduction treatment, within a range in which an effect on the engine output of the internal combustion engine does not exceed an allowable value.

Note that FIG. 5 shows the relationship between the operational state of the internal combustion engine 1 and the first intermediate opening when the first intermediate opening is determined in accordance with the operational state of the internal combustion engine 1 as the minimum opening of a range in which the effect on the engine output of the internal combustion engine 1 does not exceed a predetermined allowable value.

Here, the value of the first intermediate opening may be corrected according to the amount of trapped PM in the first exhaust purification device 11*a* in which NOx purification treatment is to be performed. The reason for this is that when the amount of trapped PM in the first exhaust purification device 11*a* to be subjected to NOx reduction treatment is large, the back pressure in the first exhaust purification device 11*a* increases such that when the second valve 12*b* is closed at the time t2, the total flow rate of the exhaust gas that can pass through the first branch passage 10*a* and second branch passage 10*b* decreases, and as a result, the engine output of the internal combustion engine 1 may be affected even more adversely.

More specifically, the map from which the first intermediate opening is read may be modified according to the amount of trapped PM in the first exhaust purification device 11*a* to be subjected to NOx reduction treatment. Alternatively, the map from which the first intermediate opening is read may be fixed, regardless of the amount of trapped PM in the first exhaust purification device 11*a*, and the first intermediate opening may be determined by multiplying a coefficient corresponding to the amount of trapped PM in the first exhaust purification device 11*a* by the valve opening value read from the map.

In this case, the trapped PM amount may be calculated from the distance traveled by the vehicle or the like following implementation of the previous PM regeneration treatment for oxidizing and removing the particulate matter trapped in the filter of the first exhaust purification device 11*a*. Alternatively, an exhaust pressure sensor, not shown in the drawings, may be provided to the front and rear of the first exhaust purification device 11*a* so that the back pressure can be detected directly from the difference in the output of the front and rear exhaust pressure sensors of the first exhaust purification device 11*a*.

Furthermore, in this embodiment, values of the first intermediate opening derived from the two methods described above and corresponding to the operational state of the internal combustion engine 1 may be compared, and the value corresponding to the larger opening may be set as the final first intermediate opening. More specifically, an opening of the second valve 12*b* for optimizing the NOx purification performance of the first exhaust purification device 11*a* following the completion of NOx reduction treatment is set in accordance with the operational state of the internal combustion engine 1 as the final first intermediate opening.

However, when the determined value of the first intermediate opening is smaller than the minimum opening of the range in which the effect on the engine output of the internal combustion engine 1 does not exceed the predetermined allowable value in accordance with the operational state of the internal combustion engine 1 at this time, the minimum opening of the range in which the effect on the engine output of the internal combustion engine 1 does not exceed the predetermined allowable value in this operational state is used as the first intermediate opening.

Figure 6:
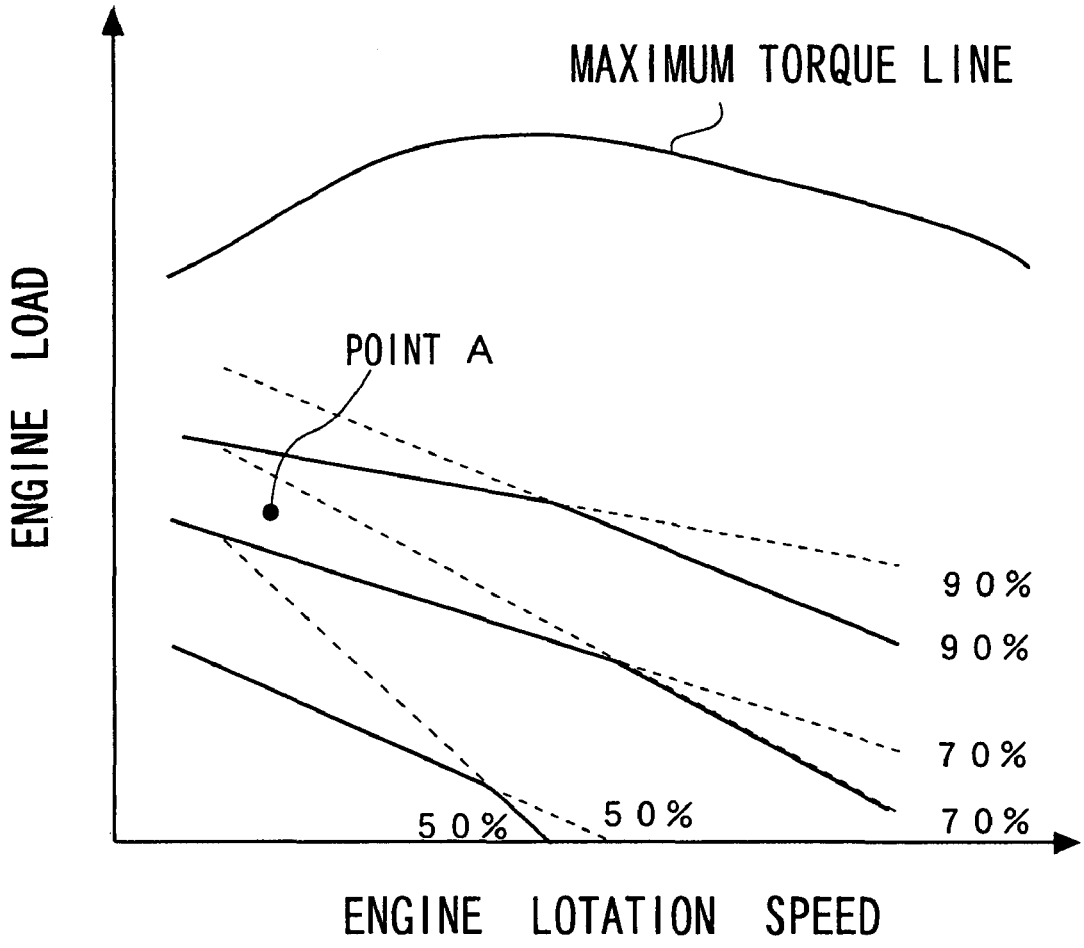
FIG. 6 is a graph illustrating the relationship between the operational state of the internal combustion engine according to the first embodiment of the present invention, and a valve opening of the second valve during NOx reduction treatment at which the NOx purification performance of the first exhaust purification device is optimized following NOx reduction treatment within a range in which the effect on the engine output of the internal combustion engine does not exceed an allowable value.

In so doing, an opening of the second valve 12*b* at which the NOx purification performance of the first exhaust purification device 11*a* following NOx reduction treatment is maximized without adversely affecting the engine output of the internal combustion engine 1 can be determined as the first intermediate opening in accordance with the operational state of the internal combustion engine 1. FIG. 6 shows the relationship between the operational state of the internal combustion engine 1 and the first intermediate opening in this case.

In FIG. 6, the broken lines show the opening values of the second valve 12*b* shown in FIGS. 4 and 5, respectively, while the solid lines indicate cases where lines on which a larger opening is obtained are selected as the first intermediate opening. A map may be created on the basis of the solid lines in FIG. 6, and a value of the first intermediate opening corresponding to the operational state of the internal combustion engine 1 may be read from the map. For example, when the operational state of the internal combustion engine 1 is denoted by a point A in FIG. 6, the valve opening for optimizing the NOx purification efficiency of the first exhaust purification device 11*a* following the completion of NOx reduction treatment is 65%. On the other hand, the minimum value at which the effect on the engine output of the internal combustion engine 1 does not exceed the allowable value is 75%, and hence in this case, 75% is selected as the first intermediate opening.

Note that in the embodiment described above, a case in which NOx reduction treatment is performed in the first exhaust purification device 11*a* was described, but similar concepts may be applied to a case in which NOx reduction treatment is performed in the second exhaust purification device 12*b*. In this case, the first branch passage 10*a*, first exhaust purification device 11*a*, first valve 12*a*, and first fuel addition valve 14*a* are replaced by the second branch passage 10*b*, second exhaust purification device 11*b*, second valve 12*b*, and second fuel addition valve 14*b*, respectively. This applies likewise to the following description.

Second Embodiment

Next, a second embodiment of the present invention will be described. In the second embodiment, control performed in a case where the operational state of the internal combustion engine 1 belongs to the low-medium load region and NOx reduction treatment is performed in the first exhaust purification device 11*a* will be described. In this case, the second valve 12*b* is closed to a second intermediate opening after the first valve 12*a* is fully closed.

Figure 7:
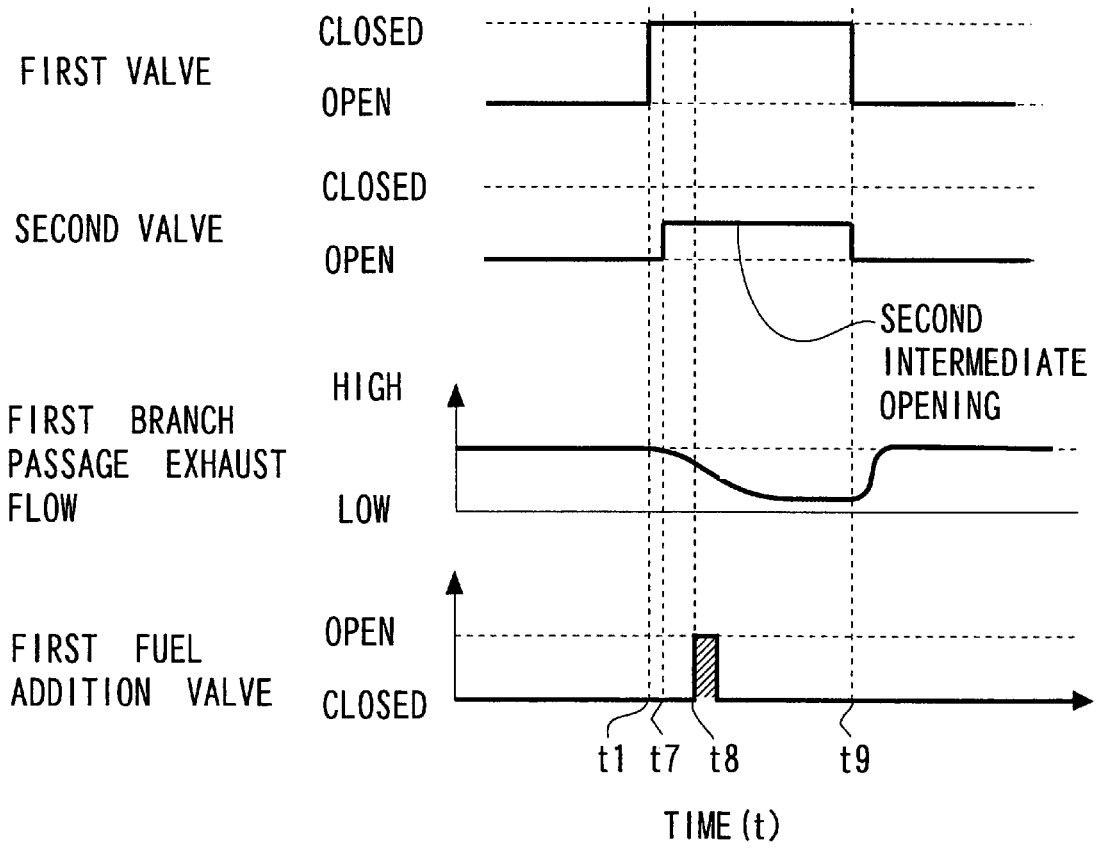
FIG. 7 is a time chart showing open/close operations of a first valve and a second valve, variation in an exhaust flow in a first branch passage accompanying these open/close operations, and an open/close operation of a first fuel addition valve when NOx reduction treatment is performed on a first exhaust purification device according to a second embodiment of the present invention.

FIG. 7 is a time chart showing open/close operations of the exhaust flow control valves, variation in the exhaust flow in the first branch passage 10*a* accompanying these open/close operations, and an open/close operation of a first fuel addition valve when NOx reduction treatment is performed in the first exhaust purification device 11*a*.

Specifically, control performed when the operational state of the internal combustion engine 1 belongs to the low-medium load region, whereby a reducer can be supplied to the exhaust purification device sufficiently by adding a reducer as is to the exhaust gas passing through each branch passage, will be described.

According to FIG. 7, first, at a time t1, the first valve 12*a* is fully closed. As a result, the flow rate of the exhaust gas passing through the first branch passage 10*a* begins to decrease. Then, at a time t7, the second valve 12*a* is closed to the second intermediate opening. As a result, a part of the exhaust gas passing through the second branch passage 10*b* flows into the first branch passage 10*a*, which is gradually entering a fully closed state, and therefore, the decrease gradient of the exhaust flow in the first branch passage 10*a* becomes gentler.

Here, the second intermediate opening corresponds to the purification performance regeneration opening of this embodiment, but may take a different value to the first intermediate opening described above. Similarly to the first intermediate opening, the second intermediate opening may be set at a predetermined fixed value. Alternatively, the second intermediate opening may be set in accordance with the operational state of the internal combustion engine 1 at an opening for optimizing the NOx purification efficiency of the first exhaust purification device 11*a* following the completion of NOx reduction treatment. Further, the second intermediate opening may be set in accordance with the operational state of the internal combustion engine 1 at a minimum value of a range in which the effect on the engine output of the internal combustion engine 1 does not exceed a predetermined allowable value.

Next, at a time t8, fuel is added from the first fuel addition valve 14*a*. In other words, fuel is added from the first fuel addition valve 14*a* while the flow rate of the exhaust gas passing through the first branch passage 10*a* is decreasing gently. Thus, the fuel added by the first fuel addition valve 14*a* can be supplied to the first exhaust purification device 11*a* with stability over a long time period. As a result, the setting precision required at the time t8, when fuel addition from the fuel addition valve 14*a* begins, can be eased, and a large amount of fuel can be supplied to the first exhaust purification device 11*a* favorably.

At a time t9, when it is assumed that NOx reduction has been performed to a sufficient extent in the first exhaust purification device 11*a*, the first valve 12*a* and second valve 12*b* are fully opened, and the flow rate of the exhaust gas passing through the branch passages returns to the state prior to the time t1.

As described above, this embodiment illustrates a case in which the operational state of the internal combustion engine 1 is in the low-medium load region and sufficient transportability for supplying the fuel added to the exhaust purification device by the fuel addition valve is secured. In such a case, the first valve 12*a* in the branch passage 10*a* on the NOx reduction treatment side is first fully closed, and immediately thereafter, the second valve 12*b* in the branch passage 10*b* is closed to the second intermediate opening.

In so doing, the decrease gradient of the exhaust flow in the first branch passage 10*a*, in which NOx reduction treatment is performed, can be made gentler, and therefore the reducer can be supplied to the first exhaust purification device 11*a* with stability over a long time period. Hence, the required precision of the fuel addition timing from the first fuel addition valve 14*a* can be eased, and a large amount of fuel can be supplied to the first exhaust purification device 11*a* more reliably.

Third Embodiment

A third embodiment of the present invention will now be described. In the third embodiment, a case in which NOx reduction treatment in the first exhaust purification device 11*a* and NOx reduction treatment in the second exhaust purification device 11*b* are performed consecutively will be described.

Figure 8:
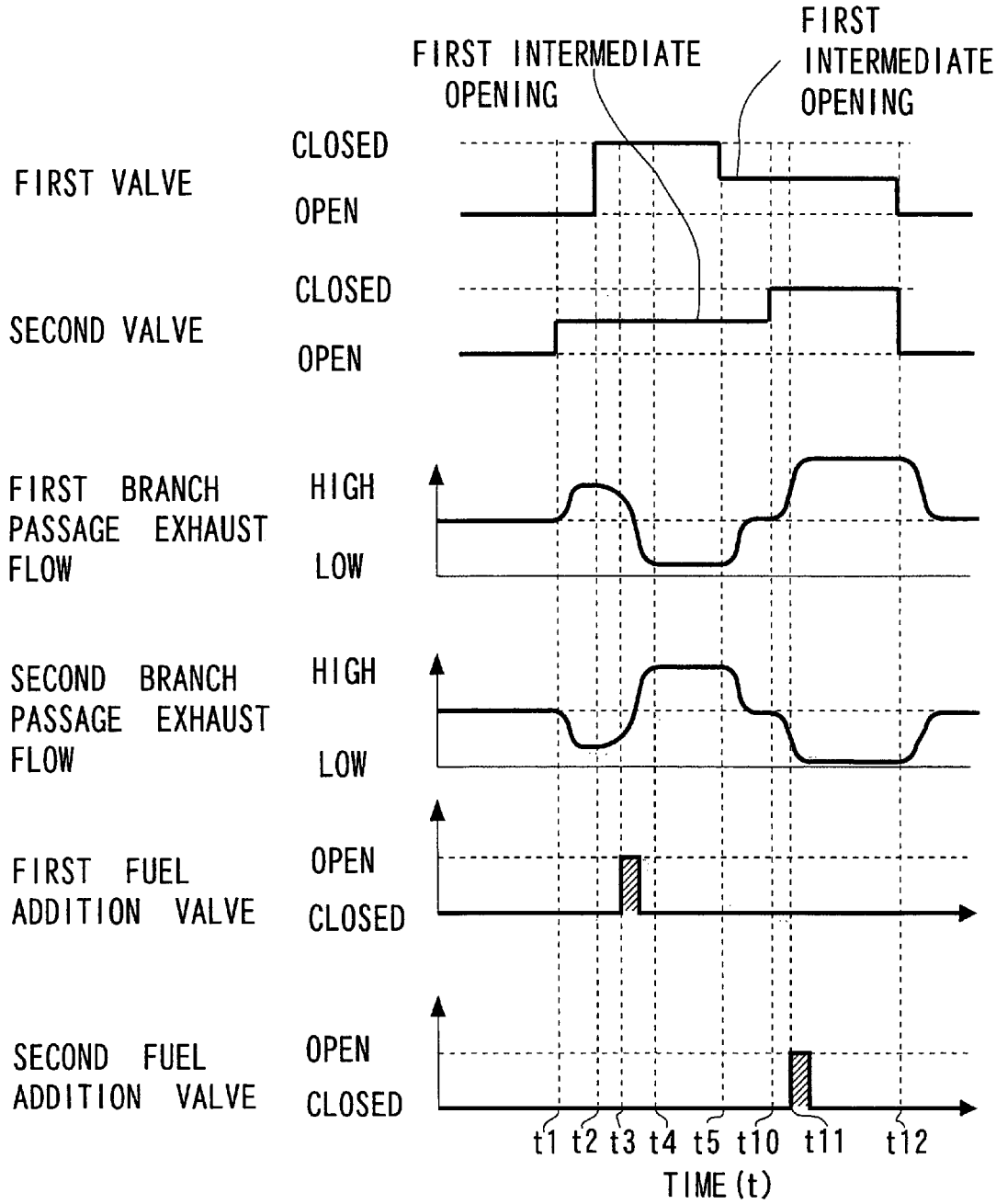
FIG. 8 is a time chart showing open/close operations of a first valve and a second valve, variation in an exhaust flow in a first branch passage and a second branch passage accompanying these open/close operations, and open/close operations of a first fuel addition valve and a second fuel addition valve when NOx reduction treatment is performed consecutively on a first exhaust purification device and a second exhaust purification device according to a third embodiment of the present invention.

FIG. 8 is a time chart showing open/close operations of each of the exhaust flow control valves, variation in the exhaust flow in the first branch passage 10*a* and second branch passage 10*b* accompanying these open/close operations, and open/close operations of the first fuel addition valve 14*a* and second fuel addition valve 14*b*, when NOx reduction treatment is performed consecutively in the first exhaust purification device 11*a* and second exhaust purification device 11*b*.

In FIG. 8, control performed from a time t1 to a time t4 is identical to the control described in FIG. 3, and therefore description thereof has been omitted. In the control illustrated in FIG. 3, the first valve 12*a* is fully opened at the time t5, and the second valve 12*b* is fully opened at the time t6. In this embodiment, on the other hand, when NOx reduction treatment in the first exhaust purification device 11*a* is complete, NOx reduction treatment is performed immediately thereafter in the second exhaust purification device 11*b*, and therefore the first valve 12*a* is opened to the first intermediate opening at the time t5, rather than being fully opened.

As a result, both the first valve 12*a* and second valve 12*b* are at the first intermediate opening. Hence, the flow rate of the exhaust gas passing through the second branch passage 10*b*, through which substantially all of the exhaust gas discharged from the internal combustion engine 1 has been passing up to this point, decreases to an intermediate flow rate. Simultaneously, the flow rate of the exhaust gas passing through the first branch passage 10*a*, which has been substantially zero up to this point, increases to a similar flow rate to the second branch passage 10*b*. Next, at a time t10, the second valve 12*b* is fully closed. As a result, the flow rate of the exhaust gas passing through the second branch passage 10*b* decreases further to substantially zero. Simultaneously, substantially all of the exhaust gas discharged from the internal combustion engine 1 begins to pass through the first branch passage 10*a*. Then, in this embodiment, fuel is added from the second fuel addition valve 14*b* at a time t11, during the period in which the flow rate of the exhaust gas passing through the second branch passage 10*b* is decreasing from the intermediate flow rate to substantially zero.

Thus, fuel serving as a reducer is supplied to the second exhaust purification device 11*b*, and NOx reduction in the second exhaust purification device 11*b* is begun. Next, at a time t12, after enough time has passed for NOx reduction in the second exhaust purification device 11*b* to end, both the first valve 12*a* and second valve 12*b* are fully opened. In so doing, the exhaust flows of both the first branch passage 10*a* and second branch passage 10*b* return to their states prior to the time t1.

In this embodiment, a case in which NOx reduction treatment is performed consecutively in the first exhaust purification device 11*a* and second exhaust purification device 11*b* was described. In this case, when NOx reduction in the first exhaust purification device 11*a* is complete, the first valve 12*a* is set at the first intermediate opening instead of returning to the state of fully opened, and the second valve 12*b* is switched directly to the fully closed state. After that, NOx reduction in the second exhaust purification device 11*b* begins.

In so doing, the valve-driving amount when opening and closing the first valve 12*a* and second valve 12*b* can be minimized, and back pressure variation and effects on the engine output caused thereby can be reduced to the smallest degree possible. Moreover, power consumption and noise accompanying the open/close operations of the first valve 12*a* and second valve 12*b* can also be reduced.

Note that in the above description, the internal combustion engine 1 is a diesel engine, but the embodiments described above may be applied to a gasoline engine.

Further, in the embodiments described above, a case in which NOx reduction treatment is performed on the first exhaust purification device 11*a* and the second exhaust purification device 11*b* was described, but similar control may be applied when SOx regeneration treatment or PM regeneration treatment is performed in the first exhaust purification device 11*a* and second exhaust purification device 11*b*. When PM regeneration treatment is implemented, fuel serving as a reducer may be supplied to an oxidation catalyst disposed upstream of each filter instead of the NOx catalyst.

Furthermore, in the embodiments described above, a case in which NOx reduction treatment or the like is implemented by adding fuel serving as a reducer to a storage-reduction type NOx catalyst was described. In contrast, the present invention may be applied to a selective-reduction type NOx catalyst system for reducing NOx contained in exhaust gas by supplying the exhaust passage with a urea solution serving as a reducer.

Further, in the embodiments described above, control in which NOx reduction treatment in an exhaust purification system in which the exhaust passage bifurcates into two branch passages is performed on an exhaust purification device provided in one of the branch passages was described. However, the present invention may be applied to an exhaust purification system having three or more branch passages such that when NOx reduction treatment is performed on one exhaust purification device, the opening of an exhaust flow control valve in one of the other branch passages is controlled.

The present invention may also be applied to an exhaust purification system having three or more branch passages such that when NOx reduction treatment is performed on one exhaust purification device, the opening of the exhaust flow control valve in two or more of the other branch passages is controlled. Similar concepts to those of the present invention may also be applied to an exhaust purification system having four or more branch passages such that when NOx reduction treatment is performed simultaneously on two or more exhaust purification devices, the opening of the exhaust flow control valve in two or more of the other branch passages is controlled.

Further, in the embodiments described above the term "fully closed" does not only signify a completely closed valve state, and includes a state close to a fully closed state in which the effects of the present invention can be obtained sufficiently.

INDUSTRIAL APPLICABILITY

According to the present invention, the purification performance of an exhaust purification device can be regenerated more reliably and more efficiently in an exhaust purification system combining a plurality of branch passages bifurcating from an exhaust passage and an exhaust purification device provided in each branch passage.

The invention claimed is:

1. An exhaust purification system for an internal combustion engine, comprising:

an exhaust passage, one end of which is connected to said internal combustion engine, through which exhaust gas from said internal combustion engine passes, and which bifurcates midway into a plurality of branch passages;

an exhaust purification device provided in each of said plurality of branch passages for purifying said exhaust gas passing through each of said branch passages;

an exhaust flow control valve provided in each of said plurality of branch passages for controlling a flow rate of said exhaust gas passing through each of said branch passages;

a reducer adding device provided upstream of said exhaust purification device in each of said plurality of branch passages for adding a reducer to said exhaust gas passing through each of said branch passages; and a controller configured to control the exhaust flow control valve in each of said plurality of branch passages, such that, when said exhaust purification device provided in one of said plurality of branch passages is to be subjected to purification performance regeneration by supplying said reducer to said exhaust purification device, the controller controls said exhaust flow control valve in a branch passage provided with said exhaust purification device to be subjected to purification performance regeneration, from among said plurality of branch passages, to be substantially fully closed, and closes said exhaust flow control valve in at least one of the other branch passages such that an opening of said exhaust gas flow control valve in the at least one of the other branch passages is opened to a predetermined purification performance regeneration opening, wherein the controller is further configured to set a predetermined time difference between an operation to substantially fully close said exhaust flow control valve in said branch passage provided with said exhaust purification device to be subjected to purification performance regeneration, and an operation to set said opening of said exhaust flow control valve in at least one of said other branch passages to said predetermined purification performance regeneration opening, wherein, when an operational state of said internal combustion engine is in a predetermined low range region and said purification performance of said exhaust purification device provided in one of said plurality of branch passages is to be regenerated by supplying said reducer to said exhaust purification device, the controller is further configured to set said opening of said exhaust flow control valve in at least one of said other branch passages to said purification performance regeneration opening, and wherein, after the lapse of a predetermined first time period, the controller is further configured to substantially fully close said exhaust flow control valve in said branch passage provided with said exhaust purification device to be subjected to purification performance regeneration.

2. An exhaust purification system for an internal combustion engine comprising:

an exhaust passage, one end of which is connected to said internal combustion engine, through which exhaust gas from said internal combustion engine passes, and which bifurcates midway into a plurality of branch passages;

an exhaust purification device provided in each of said plurality of branch passages for purifying said exhaust gas passing through each of said branch passages; an exhaust flow control valve provided in each of said plurality of branch passages for controlling a flow rate of said exhaust gas passing through each of said branch passages;

a reducer adding device provided upstream of said exhaust purification device in each of said plurality of branch passages for adding a reducer to said exhaust gas passing through each of said branch passages; and a controller configured to control the exhaust flow control valve in each of said plurality of branch passages, such that, when said exhaust purification device provided in one of said plurality of branch passages is to be subjected to purification performance regeneration by supplying said reducer to said exhaust purification device, the controller controls said exhaust flow control valve in a branch passage provided with said exhaust purification device to be subjected to purification performance regeneration, from among said plurality of branch passages, to be substantially fully closed, and closes said exhaust flow control valve in at least one of the other branch passages such that an opening of said exhaust gas flow control valve in the at least one of the other branch passage is opened to a predetermined purification performance regeneration opening, wherein the controller is further configured to set a predetermined time difference between an operation to substantially fully close said exhaust flow control valve in said branch passage provided with said exhaust purification device to be subjected to purification performance regeneration, and an operation to set said opening of said exhaust flow control valve in at least one of said other branch passages to said predetermined purification performance regeneration opening, wherein when an operational state of said internal combustion engine is in a predetermined medium-low load region and said purification performance of said exhaust purification device provided in one of said plurality of branch passages is to be regenerated by supplying said reducer to said exhaust purification device, the controller is further configured to substantially fully dose said exhaust flow control valve in said branch passage provided with said exhaust purification device to be subjected to purification performance regeneration, and wherein, after the lapse of a predetermined second time period, the controller is further configured to set said opening of said exhaust flow control valve in at least one of said other branch passages to said purification performance regeneration opening.

3. The exhaust purification system for an internal combustion engine according to claim 1, wherein said purification performance regeneration opening is an opening of said exhaust flow control valve in at least one of said other branch passages at which said purification performance of said exhaust purification device to be subjected to purification performance regeneration is substantially optimized following purification performance regeneration, said opening being determined in accordance with an operational state of said internal combustion engine.

4. The exhaust purification system for an internal combustion engine according to claim 1, wherein said purification performance regeneration opening is a minimum opening of a range in which an effect on an engine output of said internal combustion engine does not exceed a predetermined allowable value when said exhaust flow control valve in said branch passage provided with said exhaust purification device to be subjected to purification performance regeneration is substantially fully closed and said opening of said exhaust flow control valve in at least one of said other branch passages is set at said purification performance regeneration opening, said opening being determined in accordance with an operational state of said internal combustion engine.

5. The exhaust purification system for an internal combustion engine according to claim 1, wherein said purification performance regeneration opening is a larger opening between an opening of said exhaust flow control valve in at least one of said other branch passages at which said purification performance of said exhaust purification device to be subjected to purification performance regeneration is substantially optimized following purification performance regeneration, which is determined in accordance with an operational state of said internal combustion engine, and a minimum opening of a range in which an effect on an engine output of said internal combustion engine does not exceed a predetermined allowable value when said exhaust flow control valve in said branch passage provided with said exhaust purification device to be subjected to purification performance regeneration is substantially fully closed and said opening of said exhaust flow control valve in at least one of said other branch passages is set at said purification performance regeneration opening, which is determined in accordance with said operational state of said internal combustion engine.

6. The exhaust purification system for an internal combustion engine according to claim 1, wherein, when the purification performance regeneration for said exhaust purification device provided in one of said plurality of branch passages is complete, and said exhaust purification device in said branch passage provided with said exhaust flow control valve that is set at said purification performance regeneration opening during said regeneration is subjected to purification performance regeneration immediately afterwards, said opening of said exhaust flow control valve in said branch passage provided with said exhaust purification device that has completed purification performance regeneration is switched from a substantially fully closed state to said purification performance regeneration opening, and said opening of said exhaust flow control valve in said branch passage provided with said exhaust purification device to be subjected to purification performance regeneration subsequently is switched from said purification performance regeneration opening to said substantially fully closed state.

7. The exhaust purification system for an internal combustion engine according to claim 2, wherein said purification performance regeneration opening is an opening of said exhaust flow control valve in at least one of said other branch passages at which said purification performance of said exhaust purification device to be subjected to purification performance regeneration is substantially optimized following purification performance regeneration, said opening being determined in accordance with an operational state of said internal combustion engine.

8. The exhaust purification system for an internal combustion engine according to claim 2, wherein said purification performance regeneration opening is a minimum opening of a range in which an effect on an engine output of said internal combustion engine does not exceed a predetermined allowable value when said exhaust flow control valve in said branch passage provided with said exhaust purification device to be subjected to purification performance regeneration is substantially fully closed and said opening of said exhaust flow control valve in at least one of said other branch passages is set at said purification performance regeneration opening, said opening being determined in accordance with an operational state of said internal combustion engine.

9. The exhaust purification system for an internal combustion engine according to claim 2, wherein said purification performance regeneration opening is a larger opening between an opening of said exhaust flow control valve in at least one of said other branch passages at which said purification performance of said exhaust purification device to be subjected to purification performance regeneration is substantially optimized following purification performance regeneration, which is determined in accordance with an operational state of said internal combustion engine, and a minimum opening of a range in which an effect on an engine output of said internal combustion engine does not exceed a predetermined allowable value when said exhaust flow control valve in said branch passage provided with said exhaust purification device to be subjected to purification performance regeneration is substantially fully closed and said opening of said exhaust flow control valve in at least one of said other branch passages is set at said purification performance regeneration opening, which is determined in accordance with said operational state of said internal combustion engine.

10. The exhaust purification system for an internal combustion engine according to claim 3, wherein said purification performance regeneration opening is corrected on the basis of at least one of a temperature of said exhaust purification device to be subjected to purification performance regeneration and a back pressure produced by said exhaust purification device to be subjected to purification performance regeneration in said branch passage provided with said exhaust purification device.

11. The exhaust purification system for an internal combustion engine according to claim 4, wherein said purification performance regeneration opening is corrected on the basis of at least one of a temperature of said exhaust purification device to be subjected to purification performance regeneration and a back pressure produced by said exhaust purification device to be subjected to purification performance regeneration in said branch passage provided with said exhaust purification device.

12. The exhaust purification system for an internal combustion engine according to claim 5, wherein said purification performance regeneration opening is corrected on the basis of at least one of a temperature of said exhaust purification device to be subjected to purification performance regeneration and a back pressure produced by said exhaust purification device to be subjected to purification performance regeneration in said branch passage provided with said exhaust purification device.

13. The exhaust purification system for an internal combustion engine according to claim 7, wherein said purification performance regeneration opening is corrected on the basis of at least one of a temperature of said exhaust purification device to be subjected to purification performance regeneration and a back pressure produced by said exhaust purification device to be subjected to purification performance regeneration in said branch passage provided with said exhaust purification device.

14. The exhaust purification system for an internal combustion engine according to claim 8, wherein said purification performance regeneration opening is corrected on the basis of at least one of a temperature of said exhaust purification device to be subjected to purification performance regeneration and a back pressure produced by said exhaust purification device to be subjected to purification performance regeneration in said branch passage provided with said exhaust purification device.

15. The exhaust purification system for an internal combustion engine according to claim 9, wherein said purification performance regeneration opening is corrected on the basis of at least one of a temperature of said exhaust purification device to be subjected to purification performance regeneration and a back pressure produced by said exhaust purification device to be subjected to purification performance regeneration in said branch passage provided with said exhaust purification device.

16. The exhaust purification system for an internal combustion engine according to claim 2, wherein when the purification performance regeneration for said exhaust purification device provided in one of said plurality of branch passages is complete, and said exhaust purification device in said branch passage provided with said exhaust flow control valve that is set at said purification performance regeneration opening during said regeneration is subjected to purification performance regeneration immediately afterwards, said opening of said exhaust flow control valve in said branch passage provided with said exhaust purification device that has completed purification performance regeneration is switched from a substantially fully closed state to said purification performance regeneration opening, and said opening of said exhaust flow control valve in said branch passage provided with said exhaust purification device to be subjected to purification performance regeneration subsequently is switched from said purification performance regeneration opening to said substantially fully closed state.

* * * * *